US012366158B2

(12) United States Patent
Hird et al.

(10) Patent No.: US 12,366,158 B2
(45) Date of Patent: Jul. 22, 2025

(54) DRILL BIT METAMORPHISM DETECTION

(71) Applicant: Schlumberger Technology Corporation, Sugar Land, TX (US)

(72) Inventors: Jonathan Robert Hird, Cambridge (GB); Andrew David Robinson, Cambridge (GB); Dariusz Strapoc, Plessis-Robinson (FR); Nicholas Ivars Abolins, Paris (FR); Can Evren Yarman, Paris (FR); Timothy McAlinden, Cambridge (GB); David Scott, Huntingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/690,936

(22) PCT Filed: Dec. 2, 2022

(86) PCT No.: PCT/US2022/080822
§ 371 (c)(1),
(2) Date: Mar. 11, 2024

(87) PCT Pub. No.: WO2023/102528
PCT Pub. Date: Jun. 8, 2023

(65) Prior Publication Data

US 2024/0401466 A1 Dec. 5, 2024

Related U.S. Application Data

(60) Provisional application No. 63/264,790, filed on Dec. 2, 2021.

(51) Int. Cl.
*E21B 47/013* (2012.01)
*E21B 47/07* (2012.01)

(52) U.S. Cl.
CPC ..... *E21B 47/013* (2020.05); *E21B 47/07* (2020.05)

(58) Field of Classification Search
CPC ..... E21B 47/07; E21B 47/013
See application file for complete search history.

(56) References Cited

U.S. PATENT DOCUMENTS 6,230,822 B1 * 5/2001 Sullivan ..... E21B 47/013 175/228
6,443,001 B1 9/2002 Duriez et al.
(Continued)

FOREIGN PATENT DOCUMENTS

EP 2444802 A1 4/2012
EP 2824455 A1 1/2015
(Continued)

OTHER PUBLICATIONS

Whitcar, M.J., 1990, A geochemical perspective of natural gas and atmospheric methane, Organic Chemistry, v. 16, 531-547, 17 pages.
(Continued)

*Primary Examiner* — Shane Bomar
(74) *Attorney, Agent, or Firm* — Jeffrey D. Frantz

(57) ABSTRACT

A bit to detect drill bit metamorphism (DBM) may include a bit head. A bit to detect DBM may include at least one cutting element connected to the bit head. A bit to detect DBM may include a temperature sensor on or in the at least one cutting element. A bit to detect DBM may include an electronics module in communication with the temperature sensor. A bit to detect DBM may include a wiring conduit from the at least one cutting element and through at least a portion of the bit head to the electronics module.

19 Claims, 6 Drawing Sheets

(56) References Cited

U.S. PATENT DOCUMENTS

| | | | | |
|---|---|---|---|---|
| 7,392,138 | B2 | 6/2008 | Frechin et al. | |
| 11,513,110 | B2 | 11/2022 | Rowe | |
| 2007/0062272 | A1 | 3/2007 | Frechin | |
| 2010/0264315 | A1 | 10/2010 | Okada | |
| 2011/0303463 | A1 | 12/2011 | Lessi | |
| 2014/0231142 | A1* | 8/2014 | Poitzsch | E21B 10/00 175/50 |
| 2014/0249053 | A1 | 9/2014 | Robinson | |
| 2015/0322720 | A1* | 11/2015 | Pelletier | E21B 49/005 175/41 |
| 2016/0153955 | A1* | 6/2016 | Strapoc | G01N 33/0047 702/24 |
| 2016/0273330 | A1* | 9/2016 | Dashevsky | G01V 11/007 |
| 2017/0074094 | A1 | 3/2017 | Rowe | |
| 2017/0107814 | A1 | 4/2017 | Dinariev | |
| 2020/0056478 | A1 | 2/2020 | Lima | |
| 2021/0285927 | A1 | 9/2021 | Baecker | |
| 2022/0034862 | A1* | 2/2022 | Fayez | E21B 47/10 |
| 2022/0065105 | A1* | 3/2022 | Rowe | E21B 49/005 |
| 2022/0091090 | A1 | 3/2022 | Baecker | |
| 2023/0099562 | A1* | 3/2023 | Alarawi | E21B 47/002 166/250.01 |
| 2023/0184645 | A1* | 6/2023 | Smith | G01N 1/4022 73/818 |
| 2024/0287898 | A1* | 8/2024 | Strapoc | E21B 49/005 |

FOREIGN PATENT DOCUMENTS

| | | | |
|---|---|---|---|
| WO | 2010042383 | A2 | 4/2010 |
| WO | 2020205460 | A1 | 10/2020 |
| WO | 2022047444 | A1 | 3/2022 |
| WO | 2023278327 | A1 | 1/2023 |
| WO | 2023192219 | A1 | 10/2023 |

OTHER PUBLICATIONS

Strapoc et al., Artificial alkenes and alkanes generated during drilling: Evidence and impact on petroleum exploration. 2017, IMOG, Florence, Italy; abstract, 2 pages.

Strapoc et al., Deep biogenic methane and drilling-associated gas artifacts: impact and consequences on characterization of petroleum fluids. AAPG Bulletin v 104, Apr. 2020, pp. 887-912.

Coplen et al., New Guidelines for 13C Measurements: Analytical Chemistry, v. 78, Apr. 1, 2006, pp. 2439-2441.

Douglas et al., Methane clumped isotopes: Progress and potential for a new isotopic tracer: Organic Geochemistry, v. 113, 2017, p. 262-282.

Faber et al., Gaseous hydrocarbons of unknown origin found while drilling: Organic Geochemistry, v. 13, 1988, p. 875-879.

Herbinet et al., Thermal decomposition of n-dodecane: Experiments and kinetic modeling: Journal of Analytical and Applied Pyrolysis, v. 78, 2007, p. 419-429.

Johns et al., Combined steam reforming of methane and Fischer-Tropsch synthesis for the formation of hydrocarbons: A proof of concept study: Catalysis Letters, v. 90, 2003, p. 187-194.

Kennedy et al., Frictional melting of sedimentary rock during high-speed diamond drilling: an analytical SEM and TEM investigation: Tectonophysics, v. 204, 1992, p. 323-337.

Prinzhofer et al., New geochemical characterization of natural gas and its use in oil and gas evaluation, in M.R. Mello, and B.J. Katz, eds., Petroleum Systems of South Atlantic Margins: AAPG Memoir, v. 73, p. 107-119.

Ringer et al., Real-time motor and turbine performance monitoring and optimization: IADC/SPE Drilling Conference and Exhibition, San Diego, CA, USA, Mar. 6-8, 2012, IADC/SPE 151451, 7 pages.

Wenger et al., Drill-bit metamorphism: Recognition and impact on show evaluation: Society of Petroleum Engineers, 125218-MS, Paper presented at the SPE Annual Technical Conference and Exhibition, New Orleans, Louisiana, Oct. 2009, 9 pages.

Xing et al., Kinetics and Product Distributions for Thermal Cracking of a Kerosene-Based Aviation Fuel: Energy Fuels, v. 23, 2009, p. 4021-4024.

Qubaisi et al., Using Drill Bit Metamorphism to Aid in Formation Evaluation of Tight Gas Reservoirs, IPTC-20353-MS, International Petroleum Technology Conference, Jan. 13, 2020, pp. 1-9 pp. 4-5.

Key role of regearing mud gas logging for natural hydrogen exploration, Abstract Id: 1315 for SPWLA 63rd Annual Logging Symposium, Nov. 7, 2021, 3 pages.

Han et al., On-line multi-component analysis of gases for mud logging industry using data driven Raman spectroscopy. Fuel, 207, 2017, 146-153.

Strapoc et al., Controlled drill bit metamorphism (DBM) using indoor rig floor experiments. Virtual poster presented at IMOG, Sep. 12-17, 2021, Montpelier, France, 1 page.

Wang et al., A review of cavity-enhanced Raman spectroscopy as a gas sensing method. Applied Spectroscopy Reviews, 55(5), 393-417.

* cited by examiner

DRILL BIT METAMORPHISM DETECTION

CROSS-REFERENCE TO RELATED APPLICATIONS

This application is the National Stage Entry of International Application No. PCT/US2022/080822, filed Dec. 2, 2022, which claims the benefit of, and priority to, U.S. Patent Application No. 63/264,790, filed Dec. 2, 2021. This application is also related to International Patent Application No. PCT/US2022/035123 filed Jun. 27, 2022, which claims the benefit of, and priority to, U.S. Patent Application No. 63/215,628 filed Jun. 28, 2021. Each of the foregoing is expressly incorporated herein by this reference in its entirety.

BACKGROUND

Surface analyses of drilling fluid, including oil-based mud (OBM), shows the OBM can contain gaseous species such as carbon monoxide (CO) or alkenes (e.g., ethene, propene, etc.) that are not typically found in natural gases. The presence of such gasses can be indicative of inefficient drilling processes that result in heat generation. In particular, these gaseous species can be generated by tribo-chemical processes at the cutter-fluid-rock interface. These tribo-chemical processes may cause cracking of base oil hydrocarbons, a process referred to herein as drill bit metamorphism (DBM). The DBM also generates alkanes (methane, ethane, propane, etc. and benzene) that can be chemically identical to the reservoir fluids, which may cause misinterpretation of reservoir richness and of indigenous fluid typing. Additionally, DBM can generate $H_2$ which can impair natural hydrogen gas exploration.

SUMMARY

In some embodiments, the techniques described herein relate to a drill bit for at-bit detection of drill bit metamorphism. The drill bit includes a bit head. At least one cutting element is connected to the bit head. A temperature sensor is located on or in the at least one cutting element. The drill bit includes an electronics module. A wiring conduit extends from the at least one cutting element and through at least a portion of the bit head to the electronics module.

In some embodiments, the techniques described herein relate to a method for performing at-bit detection of drill bit metamorphism. The method includes detecting temperature data at a cutting element of a drill bit using a temperature sensor in or on the cutting element. The temperature data is recovered from the drill bit and synchronized with at least one of surface gas data or drilling data.

In some embodiments, the techniques described herein relate to a method for detecting and mitigating drill bit metamorphism. The method includes measuring temperature measurements at one or more points of contact between a downhole tool and a rock and correlating the temperature measurements with a production of gas in drilling fluid.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a representation of a cross-sectional view of a bit, according to at least one embodiment of the present disclosure;

FIG. 2-2 is a representation of a bottom view of the bit of FIG. 2-1;

DETAILED DESCRIPTION

Figure 1:
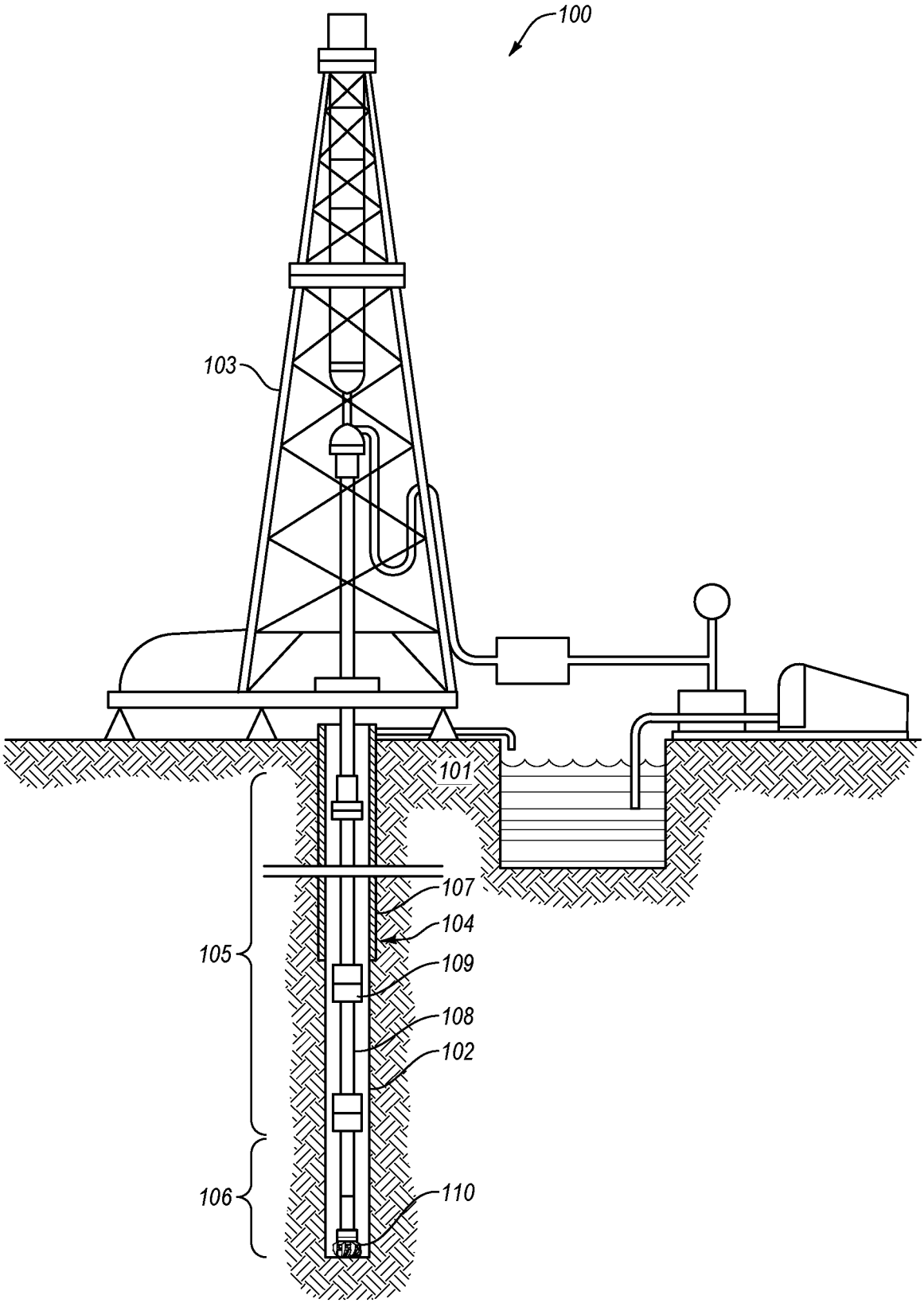
FIG. 1 shows one example of a drilling system for drilling an earth formation to form a wellbore, according to at least one embodiment of the present disclosure.

Embodiments of the present disclosure relate to at-bit detection of drill bit metamorphism. More particularly, some embodiments relate to at-bit detection of drill bit metamorphism at the bit. A drill bit may include a temperature sensor located on or in a cutting element. The temperature sensor may measure a temperature of the cutting element. This cutting element temperature may be indicative of a mud temperature of the drilling fluid. The temperature of the drilling fluid may be associated with drill bit metamorphism (DBM). By measuring the temperature of the cutting element, a downhole drilling tool may determine whether DBM is occurring. The temperature of the cutting element, and the associated determination of the occurrence of DBM, may be associated with a time and/or depth of the bit. This may help a drilling operator to determine if DBM has occurred, thereby allowing the drilling operator to determine whether gas readings from the drilling fluid are representative of composition of the formation.

The chemical processes by which DBM occurs may resemble flash pyrolysis, or a short-term exposure to very high temperatures at the cutter working edge hot spots. A synergy created by the heat produced by friction together and the high contact pressures at cutter tips may create the conditions that cause cracking to occur. The frictional heat generated at the drill bit cutters is a complex function of many parameters including (by way of illustration only): bottomhole temperature; operating parameters such as weight-on-bit (WOB), torque, bit rotary speed; rock properties; bit type and geometry; bit wear; fluid flow; cutter type and geometry; and the thermal properties of cutters. In addition, dysfunction conditions encountered during drilling can also cause elevated cutter temperatures. Examples of such conditions include cutter loss or breakage, cutter wear, and bit balling.

The impact of DBM on the composition of gasses in the drilling fluid can depend on the relative proportions of hydrocarbons derived from a drilled formation and those generated by DBM in a unit volume of mud. DBM bias may be a representation of the misrepresentation of the properties of a formation or reservoir due to the presence of DBM. A high DBM bias may be indicative of high levels of hydrocarbon gasses in the drilling fluid caused by DBM. As discussed herein, the levels of hydrocarbon gasses in the drilling fluid may alter the interpretation of the natural gas in a reservoir. For example, elevated levels of hydrocarbon gasses may increase the interpreted richness of the reservoir. In some examples, DBM may adjust the ratio of hydrocarbon gasses in the drilling fluid, which may impact the extraction and/or processing of the produced gas. In some examples, DBM may impact the amount of $H_2$ detected in the drilling fluid.

In some situations, DBM bias may occur when OBM is used as the drilling fluid when drilling through a deep, hard formation. In such a scenario, the ROP may be low and therefore the potential exists for elevated levels of heat generated at the bit-rock interface. The risk of DBM bias may be enhanced if the drilled formation contains relatively low gas concentrations, as in the case of a low-GOR (gas-oil-ratio) black oil reservoir. As wellbores continue to expand deeper, along horizontal segments, and using polycrystalline diamond compact (PDC) and diamond-impregnated bits, DBM may be more frequently observed. In some situations, turbo-drilling and other methods employing downhole mud motors may result in higher bit rotational speeds to enhance the rate-of-penetration, and may induce higher temperatures at the bit-rock interface, thereby increasing the DBM bias.

Laboratory experiments suggest that $H_2$ and CO may be produced via thermal cracking. In these experiments it was shown that cracking of base oil alone generated wet gas with high $H_2$ and CO. These results have implications for natural hydrogen gas exploration, and some aspects of the present disclosure also provide an experimental basis for DBM-correction of hydrogen gas readings in mud gas. This may help to improve the interpretation of natural hydrogen gas reservoirs.

Recognition of the process of, and products produced by DBM, can be significant in order to provide effective drilling operations and evaluation of indigenous hydrocarbons. DBM can be readily recognized by macroscopic and microscopic observation of cuttings samples and from compositional and isotopic analyses of mud gas. But such observations are taken at a surface location, or on surface analysis of mud. Since the temporal delay between DBM occurring and the mud being contaminated downhole and subsequently being detected at surface could be of the order of one or more hours, downhole—or even at-the-bit—at-bit detection of DBM could provide a more efficient and timely manner of making corrections to drilling parameters to minimize or eliminate DBM.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

In accordance with at least one embodiment of the present disclosure, there may be a correlation between conditions at the bit 110 and DBM generation. Using the bit conditions, a drilling operator may be able to adjust the drilling conditions to find a balance between DBM generation and ROP. The drilling operator may consider the time taken to trip the bit 110 back to the surface for repair and/or replacement. For example, a drilling operator may manage drilling conditions to reduce DBM. This may reduce the rate of penetration (ROP) of the drilling system but may reduce wear and other consequences at the bit, thereby reducing the number of trips out of the bit. This may result in an overall decrease in the amount of time to reach the section target depth. In this manner, identifying DBM downhole may help to increase the overall ROP of a drilling system.

In accordance with at least one embodiment of the present disclosure, the temperature at a cutting element on the bit 110 may be correlated with DBM occurrence. The temperature of the cutting element may increase based on frictional and/or impact contact with the wellbore wall. For example, contact with the wellbore wall may increase the temperature of the cutting element. As discussed herein, the drilling fluid may be used to cool the bit. This may cause the temperature of the drilling fluid to increase, or the temperature of at least a portion of the drilling fluid proximate to and in contact with the cutting element. Measuring the temperature of the cutting element may allow a DBM detector to determine the temperature of the drilling fluid at and/or near the cutting element. If the fluid temperature of the drilling fluid exceeds a DBM threshold temperature, the DBM detector may determine that DBM has occurred. In some embodiments, if the temperature of the cutting element (e.g., PDC cutter) exceeds the DBM threshold temperature, the DBM detector may determine that DBM has occurred. In this manner, collecting temperature measurements at the cutting element may allow the DBM detector to detect the occurrence of DBM at the downhole tool.

Figures 1, 2:
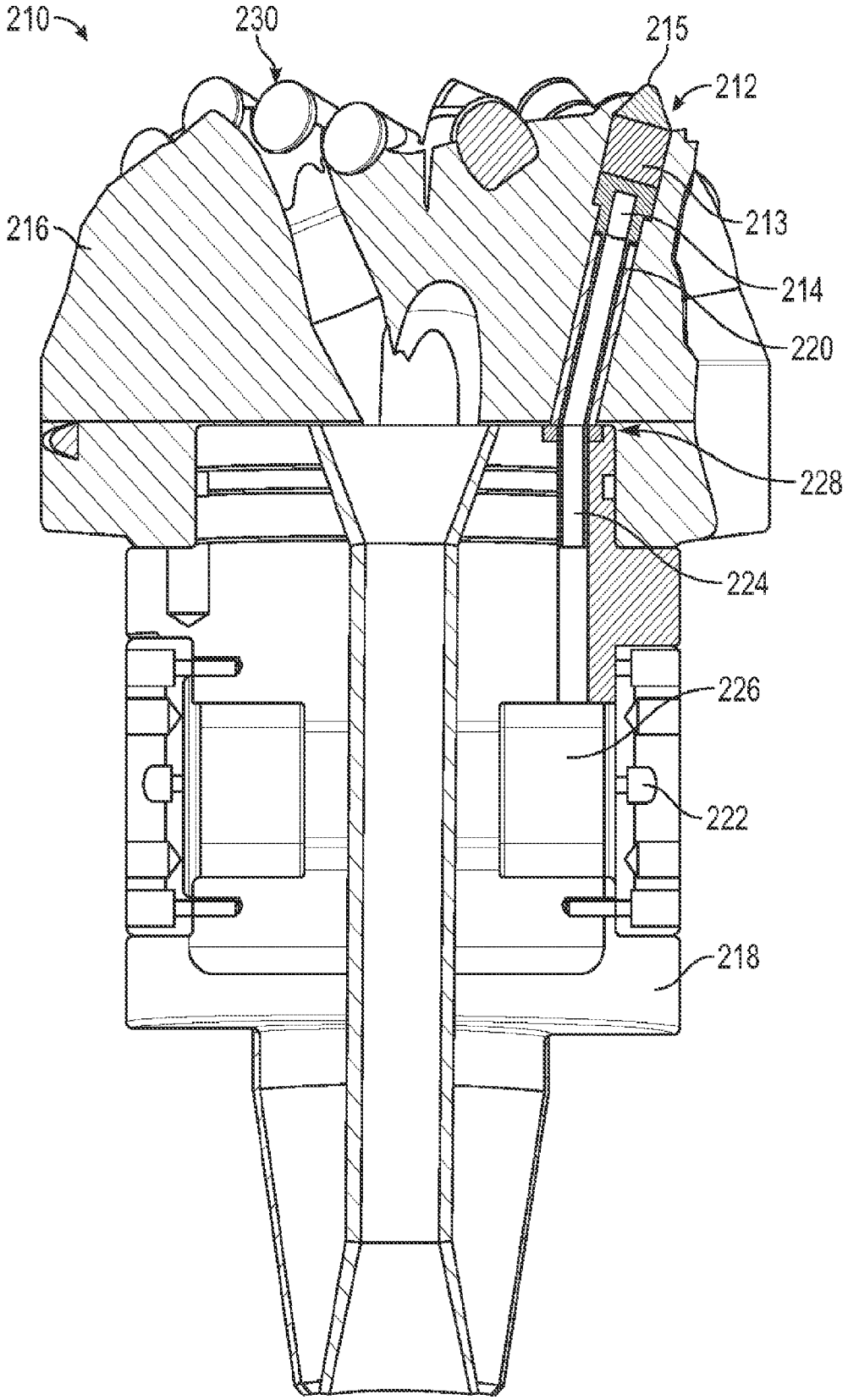
Figure 2:
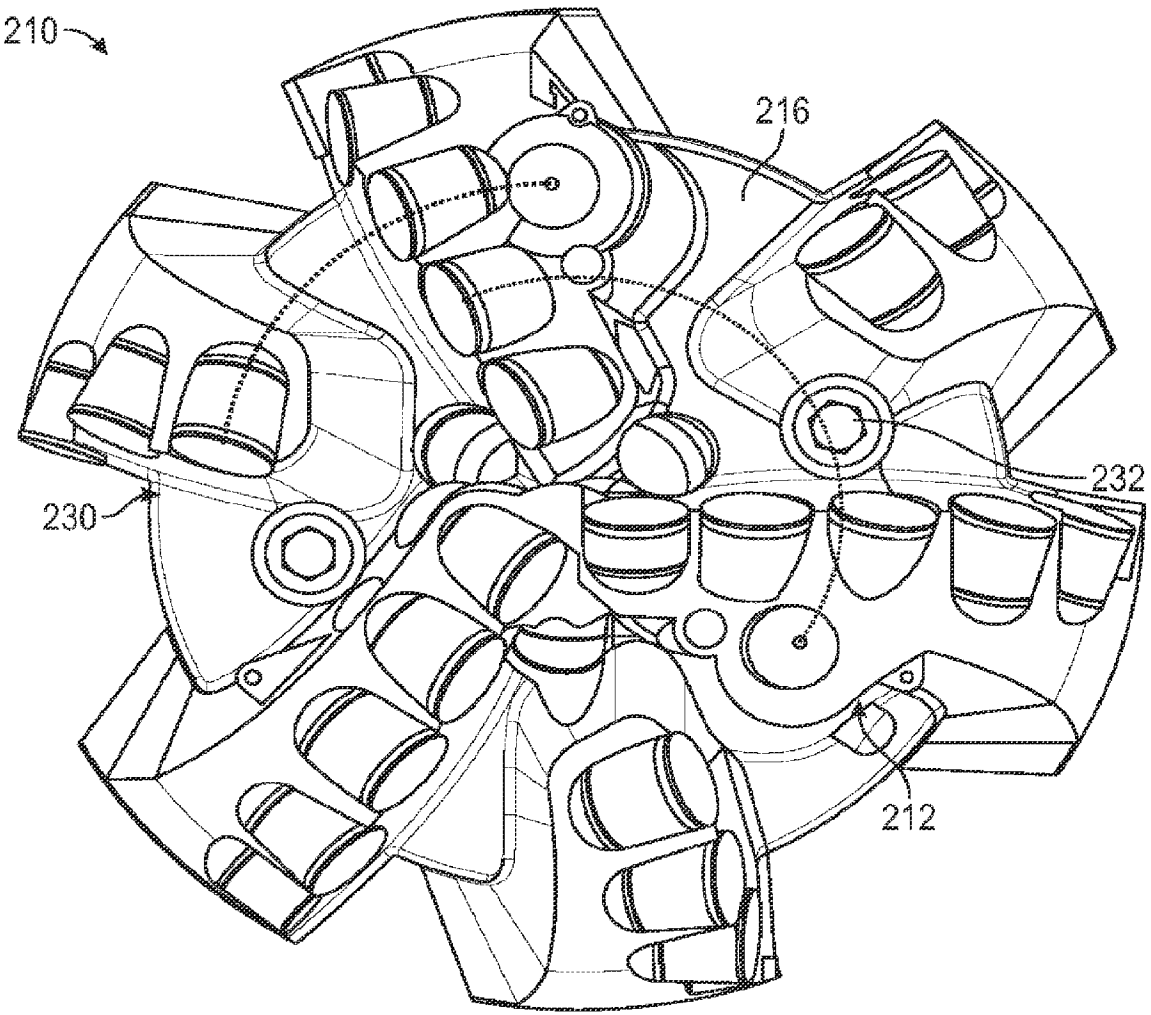

FIG. 2-1 is a cross-sectional view of a bit 210, according to at least one embodiment of the present disclosure. The bit 206 may be instrumented to detect DBM. In this embodiment, a cutting element 212 may be instrumented with a temperature sensor 214. The cutting element 212 may have any shape, including a conical or ridged cutting surface (as shown), a convex cutting surface, a concave cutting surface, a planar cutting surface, any other shaped cutting surface, and combinations thereof. The temperature sensor 214 may be configured to measure the temperature on or at the cutting element 212. For example, the temperature sensor 214 may be located on or in the cutting element 212. In the embodiment shown, the temperature sensor 214 is inserted into a body 213 of the cutting element 212. In some embodiments, the body 213 may define a bore that extends into the body 213. The bore may be located in a substrate of the cutting element 212, such as a tungsten carbide substrate or other substrate. In some embodiments, the bore may extend into the insert of the cutting element 212. For example, the bore may extend into a polycrystalline diamond (PCD) insert connected to the substrate.

The temperature sensor 214 may be any type of temperature sensor. For example, the temperature sensor 214 may include a thermocouple, a resistance temperature detector (RTD), thermistor, semiconductor-based temperature sensor, infrared temperature sensor, thermometer, bimetallic sensors, change-of-state sensors, silicon diodes, any other types of temperature sensor, and combinations thereof.

The temperature sensor 214 may be inserted into the bore. Inserting the temperature sensor 214 into the bore may allow the temperature sensor 214 to collect temperature measurements of the cutting element 212 that are representative of the temperature of the cutting element 212. As discussed herein, frictional and contact forces of the interface 215 with the rock of the wellbore may increase the temperature of the cutting element 212. In some embodiments, inserting the temperature sensor 214 into the bore may allow the temperature sensor 214 to be placed closer to the interface 215 of the cutting element 212 to the rock, or cutting surface of the cutting element 212, which may make the temperature measurements more representative of the actual temperature of the cutting element 212 at the interface 215 of the cutting element 212 to the rock. This may help to improve the detection of DBM at the interface 215.

In some embodiments, the temperature sensor 214 may be located at any other location relative to the cutting element 212. For example, the temperature sensor 214 may be in contact with the cutting element 212, the temperature sensor 214 may be located adjacent to the cutting element 212. The temperature sensor 214 may be located close to the outer surface of the bit head 216 parallel to the cutting element 212.

The bit 210 includes a bit head 216 connected to a pin 218. A wiring conduit 220 may extend through at least a portion of the bit head 216 to the pin 218. The wiring conduit 220 may allow wiring from the temperature sensor 214 to extend through the bit head 216 to an electronics module 222 in the pin 218. In some embodiments, the wiring conduit 220 may include a pipe or a sleeve that is inserted into the bit head 216 during manufacturing. For example, during manufacturing, the wiring conduit 220 may be placed in at least a portion of the mould and the powder forming the bit head 216 may be flowed around at least a portion of the wiring conduit 220. When the infiltrant is infiltrated into the mould, the wiring conduit 220 may be cast in place in the bit head 216. In some embodiments, the bit head 216 may be additively manufactured, and the wiring conduit 220 and/or a void for the wiring conduit 220 may be formed during the additive manufacturing process. In some embodiments, the wiring conduit may extend through an integrally formed portion of the bit head 216. While embodiments of the present disclosure are directed to a bit pin 218, it should be understood that the bit head 216 may be connected to any other connector, including a bit box.

During assembly of the bit head 216 and the pin 218, the wiring conduit 220 may align with a pin conduit 224. The wiring from the temperature sensor 214 may pass from the wiring conduit 220 in the bit head 216 to the pin conduit 224. The pin conduit 224 may allow the wiring to pass to the electronics module 222. In this manner, the temperature sensor 214 may be connected to the electronics module 222 in the pin 218. In some embodiments, the wiring conduit 220 may be aligned with the pin conduit 224 when the bit head 216 is secured to the pin 218.

The bit head 216 may be coupled to the pin 218 in any manner. For example, the drill bit head 216 may be connected to the pin 218 with a bolted connection. In some examples, the drill bit head 216 may be connected to the pin 218 with a threaded connection. In some examples, when the bit head 216 is coupled to the pin 218, the wiring conduit 220 and the pin conduit 224 may be aligned. In some embodiments, a bolted connection between the bit head 216 and the pin 218 may facilitate the alignment of the wiring conduit 220 and the pin conduit 224.

As discussed herein, the bit 210 may include an electronics module 222. The electronics module 222 may receive the wiring from the temperature sensor 214 and receive measurements and/or signals from the temperature sensor 214. In some embodiments, the electronics module 222 may monitor the temperature measurements received from the temperature sensor 214. In some embodiments, the electronics module 222 may record the temperature measurements from the temperature sensor 214. In some embodiments, a drilling operator may receive the temperature measurements. For example, the drilling operator may connect to the electronics module 222 when the bit 210 is tripped to the surface.

In some examples, the temperature sensor 214 may be in communication with a downhole device. For example, the temperature sensor 214 may be in communication with an MWD, such as through a wired and/or a wireless connection. The MWD may receive the temperature measurements from the temperature sensor 214. In some embodiments, the MWD may transmit the temperature measurements to the drilling operator at a surface location. For example, the MWD may transmit the temperature measurements using any downhole communication system, including mud pulse telemetry, electromagnetic communication, wired drill pipe, drill pipe telemetry, any other downhole communication system, and combinations thereof.

When the drilling operator at the surface location receives the temperature measurements, the drilling operator may correlate the temperature measurements to DBM. For example, the drilling operator may identify whether the temperature measurements exceed a DBM temperature threshold. If the temperature measurements exceed the DBM threshold, the drilling operator may identify that DBM has occurred and/or is occurring. In some embodiments, the drilling operator may adjust the interpretation of the readings of the drilling fluid to accommodate the presence of the DBM. In some embodiments, the drilling operator may adjust one or more drilling parameters to reduce the occurrence of DBM.

In some embodiments, the electronics module 222 and/or the electronics at the MWD may determine the occurrence of DBM. For example, if the electronics module 222 determines the presence of DBM, the electronics module 222 may communicate an alert to the MWD, and the MWD may transmit the alert to the surface location. In some examples, the MWD may receive the temperature measurements and determine the presence of DBM. If the MWD determines the presence of DBM, the MWD may transmit an alert to the surface location. In some embodiments, if the electronics module 222 and/or the MWD determine the presence of DBM, the MWD may transmit an amount of DBM determined, the temperature information from the temperature sensor 214, provide a level of alert based on the amount of DBM identified, any other alert or information to the surface location, and combinations thereof.

In the embodiment shown, the pin contains one or more instrumentation pockets 226 or other features that can house or connect to electronics module 222. The wiring conduit 220 may travel from the cutting element 212 to the instrumentation pocket 226. In some embodiments, the electronics module 222 may be located in the instrumentation pocket 226. In some embodiments, the instrumentation pocket 226 may include other sensors. For example, the one or more instrumentation pockets 226 may include a force sensor, a torque sensor, an accelerometer, a gyroscopic sensor, a pressure sensor, a temperature sensor to measure temperature of the drilling fluid, any other sensors, and combinations thereof. In some embodiments, the information from the one sensors in the instrumentation pocket 226 may be used to further correlate the presence of DBM at the drill bit.

In some embodiments, the bit 210 may include a fluid and/or pressure seal between the electronic components and the drilling fluid. For example, the bit head 216 may include a head seal 228 between the bit head 216 and the pin 218 at the interface between the wiring conduit 220 and the pin conduit 224. The head seal 228 may include a sealing member, such as an O-ring or other sealing member. The head seal 228 may further include a resilient element. When the bit head 216 is secured to the pin 218, the compressive force of the connection may compress the resilient element against the sealing member. The compressed sealing member may result in a seal between the bit head 216 and the pin 218. This may help to reduce and/or prevent the ingress of drilling fluid and/or other contaminants into the wiring conduit 220 and the pin conduit 224. In some embodiments, the resilient element may be a frustoconical resilient elements, such as a Belleville washer. In some embodiments, the resistant element may include a wave spring or other resilient element. In some embodiments, the instrumentation pocket 226 may include a seal between the instrumentation pocket 226 and the borehole annulus to reduce or prevent the ingress of drilling fluid and/or other contaminants into the instrumentation pocket 226.

In some embodiments, the bit 210 may include multiple cutting elements, including the cutting element 212 and cutting element 230. One or more of the cutting elements 212 or 230 may be PDC cutters or have other compositions, and can be furnished with thermocouples or another temperature measuring sensors, thereby allowing the measurement of the cutting interface between the diamond of the rock and the surrounding rock of the formation or test setup. Practically, this can be achieved by creating a small hole in the back of cutting element 212, 230 and drilling through into the superhard table of the cutting element 212, 230 (e.g., into a polycrystalline diamond table). A thermocouple can then be inserted in this hole and potted such that it provides good thermal contact with the diamond or other superhard table.

One challenge with instrumenting drill bits is the provision of the wiring conduit 220, which in the illustrated embodiment extends from the back of the cutting element 212 through the bit head 216 and to the instrumentation pocket 226 in the pin 218 such that the data can be processed and/or logged.

In FIG. 2-1 this challenge may be solved using a detachable head design and by using conical, ridged, non-planar, planar, or other cutting elements 212 furnished with thermocouples. In some aspects, a feature of using a conical, ridged, or other cutting element 212 is that the cutting element 212 can be mounted relatively vertically (e.g., with a longitudinal axis closer to alignment with the longitudinal axis of the bit 210) and still be used for breaking the rock formation. Such elements may be used to primarily gouge or crush the rock, in contrast to other elements (e.g., cutting element 230) which may primarily shear the rock.

A vertically mounted cutter may result in wires coming from the cutting element 212 that can also exit vertically and into the bit head 216 of the bit 210 where they are protected. This may help to prevent or reduce kinking and other damage to the wiring of the temperature sensor 214. In the bit 210 shown in FIG. 2-1, the cutter assembly including cutting element 212 can include a wiring conduit 220 such as a stainless-steel tube through which the instrumentation wires pass. This tube or other wiring conduit 220 may be bonded to the cutting element 212 and pass through the bit head 216 and then into the pin 218 at the pin conduit 224.

FIG. 2-2 is a top or frontal view of the bit 210 of FIG. 2-1. As discussed herein, the bit 210 may be designed or configured to detect DBM. As shown, this bit 210 may include conical or other non-planar cutting elements 212 as well as planar cutting elements 230 (e.g., PDC shear cutters). As discussed herein, the bit 210 includes a bit head 216 secured to a pin 218. In the embodiment shown, the bit head 216 may be secured to the pin 218 with a bolted connection, such as with one or more mechanical fasteners 232. Securing the bit head 216 to the pin 218 with a bolted connection may help to align the wiring conduit 220 with the pin conduit 224. In this manner, the wiring from the temperature sensor may be routed to the electronics module 222 through the bit 210.

In some embodiments, bits of other constructions and designs may be constructed. For instance, a standard matrix or steel PDC bit with planar and/or non-planar cutting elements can be formed or machined to allow passage of wires from a cutter/sensor through the bit, and into corresponding electronics modules. The sensors may be mounted to cutters that are positioned generally vertically or generally horizontally, and which cut by crushing, gouging, shearing, or some combination thereof. In other embodiments, a bit may be manufactured with an additive manufacturing process (e.g., 3D printing) or additively manufactured components to include appropriate conduits. In still other embodiments, other bit designs (e.g., modular bits) may be used to facilitate electrical connections between components.

In some DBM applications it would be desirable to additionally equip the bit 210 to measure rotary speed and torque. This allows, for instance, the input rotary power to be calculated which can then be correlated to cutter temperature. To make this measurement cheaply the use of an X-shaped strain gauge measurement plate, or a limpet style measurement beam could be used for a measurement of torque. In the same or other embodiments, a cutter (e.g., conical cutting element 212) could be instrumented to measure shear force in addition to temperature.

The addition of force or torque sensors to a temperature measurement may help to better diagnose and distinguish between drilling conditions. Such conditions include bit balling, cutter failure, whirl, cutter wear, etc. For example, when a bit becomes balled, torque and lateral shocks will decrease, and cutter temperature will increase due to inadequate cleaning. Cutter failure can result in other cutters being loaded more, in turn causing them to generate additional heat and/or leading to imbalance of the bit. An increase in rock strength or friction coefficient can also cause cutters to heat. In such a case, the rotary power can also increase. The increased cutter temperature may then also pose a greater risk of produced DBM gaseous by-products, thus mud gas readings and drill bit (dys)functions are interlinked.

Figure 3:
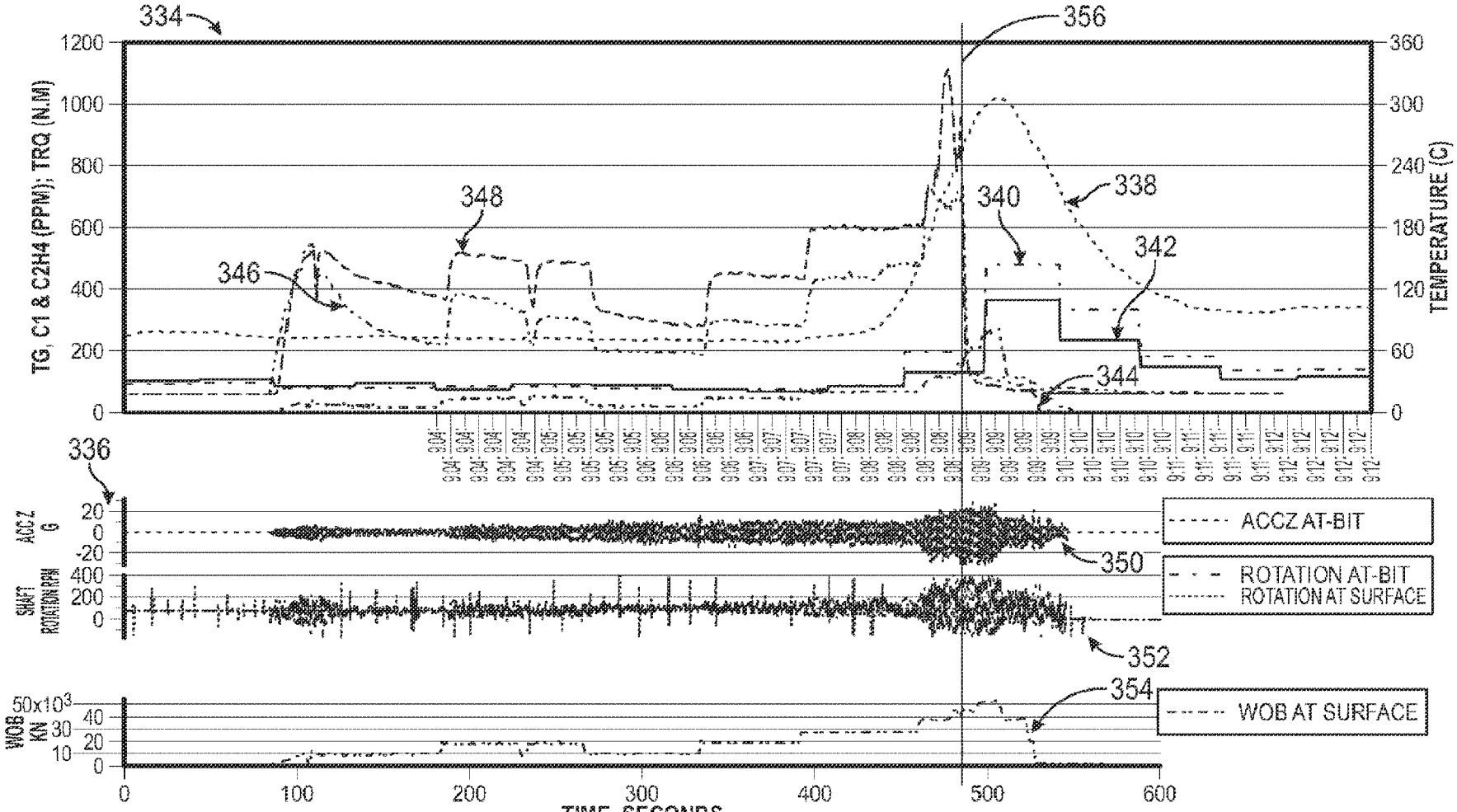
FIG. 3 illustrates experimental data of a drill bit for detecting DBM.

Recent evaluations and experiments performed with an instrumented bit show a correlation between cutter temperature, rotary power input, WOB, and concentrations of DBM-produced gases. Data from some such experiments are shown in FIG. 3, which includes an upper panel 334 and lower panel 336. The upper panel 334 shows gas analysis data for total gas 338, methane 340, and ethene 342 plotted with drilling torque 344 and the temperature measured on a first cutter 346 and a second cutter 348. The lower panel 336 shows shock data 350, rotation at the bit 352, and the weight-on-bit 354 as measured by a drilling machine. From the data, there is a clear correlation between cutter temperature, gas readings, and drilling parameters.

As discussed herein, increased gas readings of methane 340 and ethene 342 may be indicative of DBM, or may be produced by DBM. As may be seen, the spike in temperature at the reference time 356 is associated with an increase in the presence of methane 340 and ethene 342. This may allow a drilling operator and/or a DBM detector to determine that DBM has occurred. Put another way, when a temperature sensor measures elevated temperatures at the cutting element, the drilling operator and/or the DBM detector may determine that DBM has occurred based on the elevated levels of methane 340 and/or ethene 342.

In some embodiments, the increase in total gas 338, methane 340, ethene 342, and other gasses may be associated with an increase in cutting element temperature above a DBM threshold. For example, as may be seen, the cutting element temperature of the first cutter 346 and the second cutter 348 may by vary through operation before the reference time 356 without significant variations in the total gas 338, methane 340, and ethene 342. As the temperature of the first cutter 346 and the second cutter 348 increases at or near the reference time 356, the concentrations of the total gas 338, methane 340, and ethene 342 increases. The drilling operator and/or the DBM detector may identify at which temperature the increase in gas concentrations occurred, which may be the DBM threshold temperature.

In some embodiments, other drilling conditions may be associated with the presence of DBM. For example, in the experimental evidence provided in FIG. 3, the weight-on-bit 354 was increased over time. The drilling torque 344 increased, and a spike in the drilling torque 344 is observed at or near the reference time 356. The spike in drilling torque 344 may be correlated with the presence of the DBM. In some embodiments, any other drilling conditions may be associated with the presence of the DBM.

Figure 4:
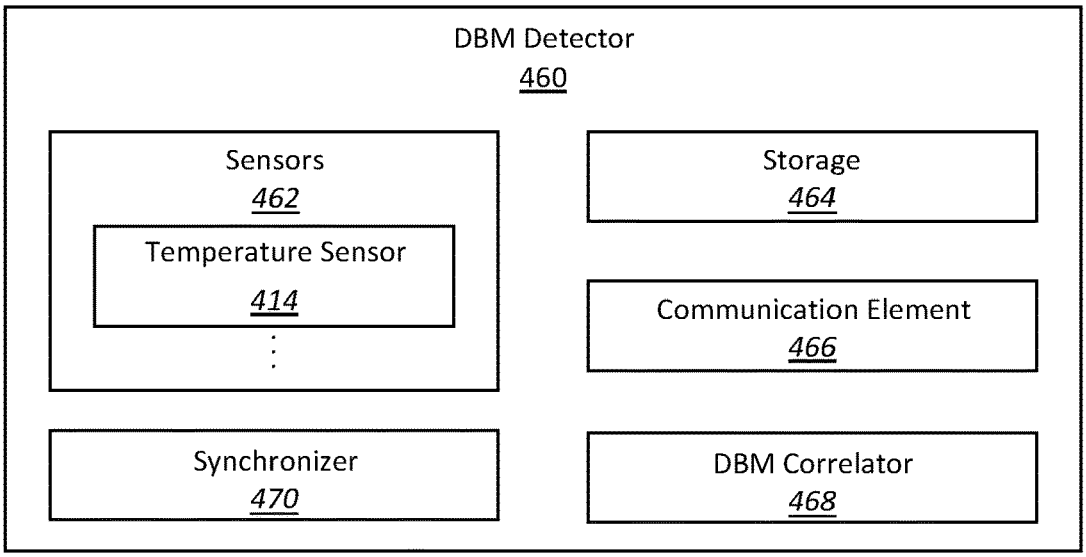
FIG. 4 is a representation of a DBM detector, according to at least one embodiment of the present disclosure.

FIG. 4 is a representation of a DBM detector 460, according to at least one embodiment of the present disclosure. Each of the components of the DBM detector 460 can include software, hardware, or both. For example, the components can include one or more instructions stored on a computer-readable storage medium and executable by processors of one or more computing devices, such as a client device or server device. When executed by the one or more processors, the computer-executable instructions of the DBM detector 460 can cause the computing device(s) to perform the methods described herein. Alternatively, the components can include hardware, such as a special-purpose processing device to perform a certain function or group of functions. Alternatively, the components of the DBM detector 460 can include a combination of computer-executable instructions and hardware.

Furthermore, the components of the DBM detector 460 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps." In some embodiments, one or more of the components of the DBM detector 460 may be implemented in a downhole environment. For example, one or more of the components of the DBM detector 460 may be implemented on a processor or computing device located on a downhole tool, such as an MWD, an LWD, or other downhole tool.

The DBM detector 460 may include or be connected to one or more sensors 462. The sensors 462 may include a temperature sensor 414, as discussed herein. In some embodiments, the sensor 462 may include any other type of sensor, such as a force sensor, a torque sensor, an accelerometer, a gyroscope, any other sensor, and combinations thereof. The sensors 462 may transmit the measured measurements to storage 464. In some embodiments, the storage 464 may be located at a surface location. In some embodiments, the storage 464 may be located downhole, such as at the MWD or the LWD. In some embodiments, the storage 464 may be located on the electronics on the bit (e.g., the electronics module 222 on the bit 210 of FIG. 2-1).

In some embodiments, the DBM detector 460 may store the measurements on the storage 464 until retrieved at a surface location. For example, the DBM detector 460 may collect measurements from the sensors 462 and store them on the storage 464. When the bit is tripped to the surface, the drilling operator may retrieve the measurements from the storage 464 and correlate them to the presence of DBM. In some embodiments, the DBM detector 460 may cache the measurements until they can be communicated to and/or retrieved by the drilling operator.

The DBM detector 460 may further include a communication element 466. The communication element 466 may communicate the measurements from the sensors 462 to another processor or storage device. In some embodiments, the communication element 466 may communicate the measurements to the MWD and/or the LWD. In some embodiments, the communication element 466 may communicate the measurements to the surface while the bit is still downhole. The communication element 466 may include any communication element, such as a downhole communication tool.

The DBM detector 460 may further include a DBM correlator 468. The DBM correlator 468 may correlate the measurements from the sensors 462 with DBM. For example, the DBM correlator 468 may identify DBM thresholds associated with the measurements. If the DBM correlator 468 determines that the measurements exceed the DBM threshold, then the DBM correlator 468 may determine the presence of DBM.

In some embodiments, the DBM correlator 468 may be located at a surface location. In some embodiments, the DBM correlator 468 may correlate the measurements to the presence of DBM downhole. In some embodiments, the DBM correlator 468 may communicate the results of the correlation to the surface location with the communication element 466. In some embodiments, the DBM correlator 468 may only communicate with surface if the presence of DBM is detected. In some embodiments, the DBM correlator 468 may provide an alert to the surface if DBM is detected.

The DBM detector 460 may further include a synchronizer 470. The synchronizer 470 may synchronize the measurements from the sensors 462 to a rig time. For example, the synchronizer 470 may synchronize the measurements from the sensors 462 with drilling property measurements measured at a surface location. In some embodiments, the synchronizer 470 may synchronize the measurements from the sensors 462 with gas reading of the drilling fluid on the surface. This may help to further correlate the measurements from the sensors 462 with the presence of DBM.

In accordance with some embodiments of the present disclosure, the DBM detector 460 may operate in various modes to detect DBM, as outlined below.

In some embodiments, the DBM detector 460 may operate in a logging mode. In some embodiments, an electronics module (e.g., electronics module 222 of FIG. 2-1) may include a combination of one or more of a microcontroller, memory or other computer-storage media, accelerometers, an angular rate sensor, or thermocouple amplifiers. The electronics device can be packaged with its own battery and/or power generator in an instrumentation pocket 226 in or near the drill bit as shown in FIG. 2-1, or can be powered by an external source such as fluid flow (e.g., through a bit, nozzle, or in the well annulus). The device can remain separate from the rest of the BHA and data can be retrieved when the drill bit is recovered at the end of the run. This data may also be synchronized to the surface gas data and drilling data. This mode may be used for research and development purposes, validating technology, or commercial, post-run services.

In some embodiments, the DBM detector 460 may operate in a measurement while drilling (MWD) mode. In some embodiments, the DBM detector 460 may be used in connection with an MWD. In such an embodiment, data from the bit can be processed downhole (at the bit or communicated to the MWD for processing). In some embodiments, the data or results of processed data, including processed temperature data, are sent to surface at regular or other time intervals where the data can be combined with surface gas data. The data sent up hole might be actual data (e.g., temperature) or a flag produced by an algorithm running downhole (e.g., a microcontroller in the bit electronics, MWD, LWD, or other tool). This might send up a simple flag such as a risk rating, or it might also indicate actionable insights on how to solve an issue. In some embodiments, time reference data, depth reference data, or a combination of time and depth reference data can bring value and applications regarding mud gas data quality and the proxies for drill bit health. Models relating the bit measurement to the surface gas measurements can be also constructed (e.g., using mud gas DBM-correction). Subsequently, other data-driven digital answer products can be provided.

In some embodiments, the DBM detector 460 may construct one or more models of bit measurements relative to surface gas measurements. For example, the DBM detector 460 may construct a model of temperature measurements relative to surface gas measurements. This may allow the DBM detector 460 to determine whether the temperature measurements are associated with DBM. In some embodiments, the DBM detector 460 may construct models of drilling parameters relative to surface gas measurements, such as weight-on-bit, torque-on-bit, drilling fluid flow rate, any other drilling parameter, and combinations thereof.

Figure 5:
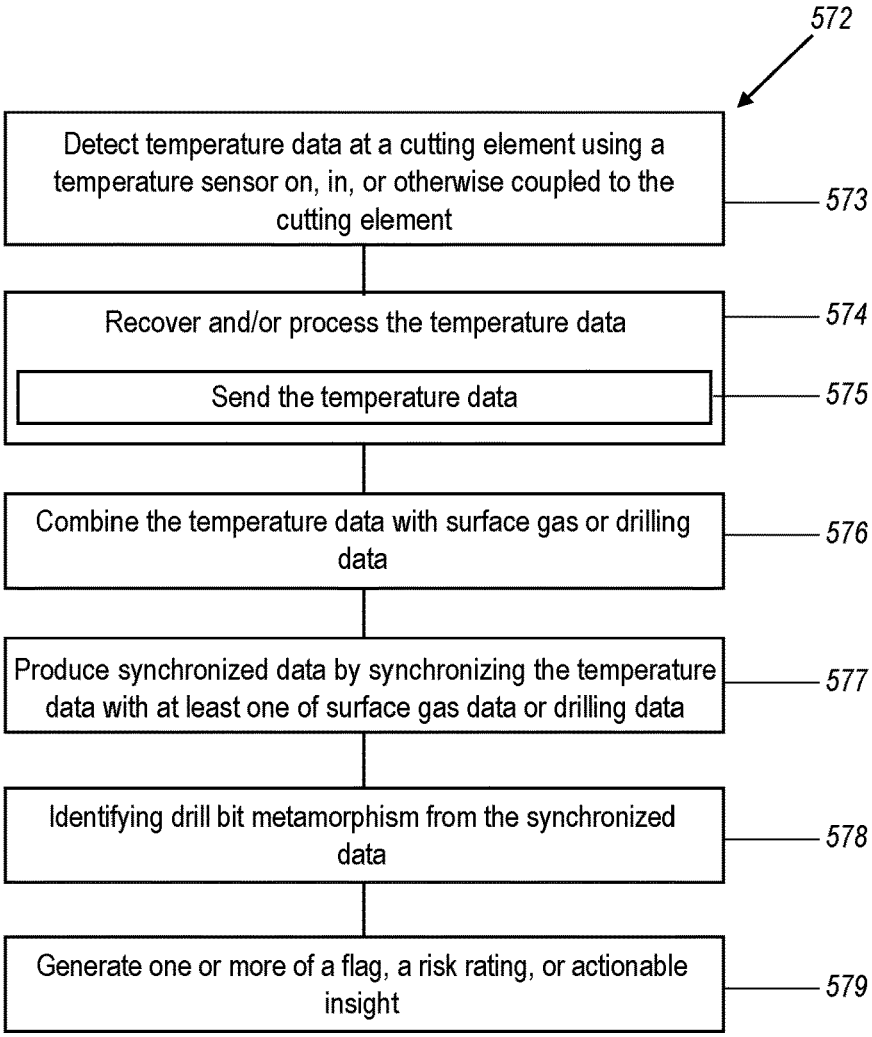
FIG. 5 is a flowchart of a method for detecting and mitigating DBM, according to at least one embodiment of the present disclosure.

FIG. 5 is a flowchart of a method 572 for detecting and mitigating DBM, according to at least one embodiment of the present disclosure. In some embodiments, the method 572 may be performed by the DBM detector 460 of FIG. 4. The DBM detector may detect temperature data at 573, with the temperature at a cutting element of a drill bit and by using a temperature sensor in or on the cutting element, or which is otherwise coupled to the cutting element. For example, as discussed herein, the temperature sensor may be located in a bore in the base of the cutting element. In some embodiments, the temperature sensor may be located on the cutting element, such as in contact or otherwise on the cutting element, or coupled to the cutting element (e.g., connected to a wire that is on or in the cutting element).

The method 572 may include recovering and/or processing the temperature data from the drill bit at 574. For example, the temperature data may be recovered after tripping the drill bit to a surface location. In some examples, the temperature data may be recovered downhole (e.g., at the bit, rotary steerable, MWD, etc.). In some examples, the temperature data may be recovered at any time during operation of the instrumented drill bit. In some embodiments, the temperature data may be processed downhole or at the surface.

In at least some embodiments, the temperature data (raw or processed) is optionally sent at 575. This may be performed as part of recovering the temperature data at 574, or as a separate act. In some embodiments, the temperature data is sent to the surface for further use or processing. For instance, the sent or otherwise recovered temperature data can be combined with surface gas or drilling data at 576. In some embodiments, the recovered temperature data (optionally including the sent temperature data) may be synchronized with at least one surface gas data or drilling data at 577 to produce synchronized data. This synchronized data may be produced from the combined data, or directly from the recovered temperature data.

The drilling fluid may be analyzed to determine the presence of gases at the surface (e.g., surface gas data). In some examples, the recovered temperature measurements may be synchronized with the surface gas data to develop one or more correlations between the surface gas data and the temperature measurements. In some examples, the recovered temperature measurements may be synchronized with the drilling data to correlate the temperature measurements with the drilling data. The drilling data may include any drilling data, such as weight-on-bit, torque-on-bit, drilling fluid flow rate, drilling fluid composition, any other drilling data, and combinations thereof.

In some embodiments, the recovered temperature measurements may be synchronized with the surface gas data and/or drilling data based on time. For example, the temperature measurements may include a time stamp that is synchronized with a surface time. In some embodiments, the recovered temperature measurements may be synchronized with the surface gas data and/or the drilling data based on depth. For example, the temperature measurements may be collected and correlated with a depth measurement as determined at the downhole tool. The surface gas measurements and/or the drilling data may be correlated with the depth measurement. In this manner, the recovered temperature measurements may be synchronized with the surface gas data and/or the drilling data.

The synchronized data may thus be used to detect DBM at 578. One or more of a flag, risk rating, or actionable insight may be generated at 579. This may be produced from the DBM identified at 578, from the processed data at 574, from the synchronized data at 577, etc. A flag may, for instance, indicate the presence of DBM or a risk of DBM. An actionable insight may include a mitigation measure to stop or slow DBM.

Figure 6:
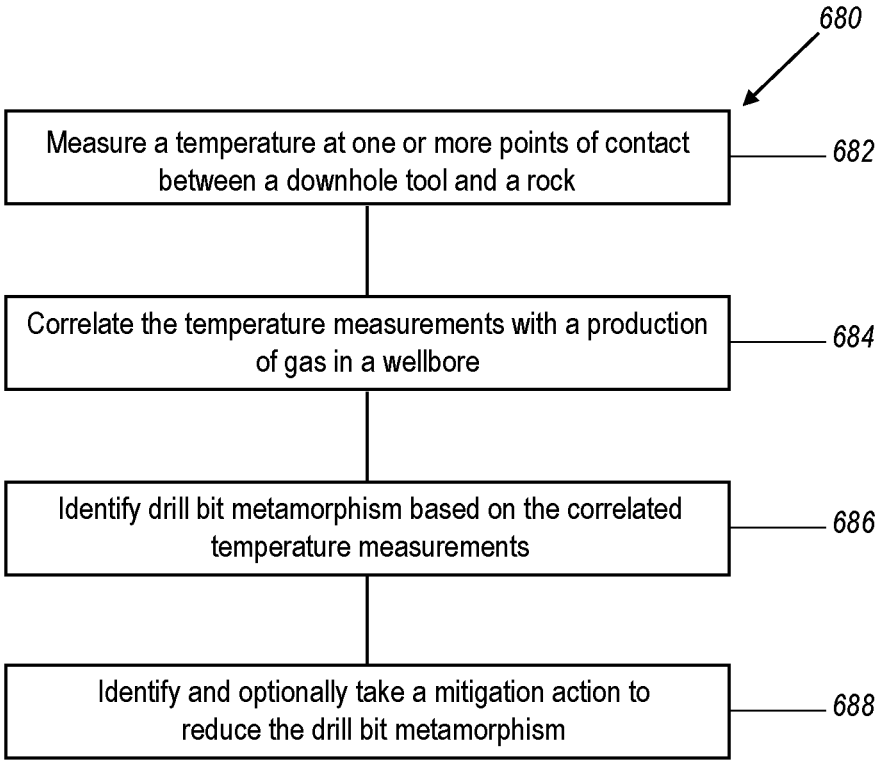
FIG. 6 is a flowchart of a method for detecting and mitigating DBM using at-bit measurements, according to at least one embodiment of the present disclosure.

FIG. 6 is a flowchart of a method 680 for detecting and mitigating DBM using at-bit measurements, according to at least one embodiment of the present disclosure. The method 680 may be performed by the DBM detector 460 of FIG. 4. The DBM detector may measure temperature measurements at one or more points of contact between a downhole tool and a rock at 682. The points of contact may include any point of contact between a downhole tool and the wellbore wall and/or base of the wellbore. For example, the point of contact may include the interface 215 between the cutting element 212 and the rock, as described with respect to FIG. 2-1. In some examples, the point of contact may include the contact of a wear strip, wear plate, or other contact element and the rock. In some examples, the point of contact may include a cutting element on a bit, a reamer, a casing cutter, any other cutting element on any other downhole tool, and combinations thereof. In some examples, the point of contact may include a gauge cutting element. In some embodiments, the point of contact may include a housing or other element on a downhole tool.

The DBM detector may correlate the temperature measurements with a production of gas in drilling fluid at 684. For example, the DBM detector may correlate the temperature measurements with the production of methane, ethene, and other hydrocarbons from an oil based mud. In some examples, the DBM detector may correlate the temperature measurements with the presence of hydrogen gas from a formation and/or reservoir. In some examples, the DBM detector may correlate the temperature measurements with any other gas production in the drilling fluid. In this manner, the DBM detector may correlate and identify the presence of DBM in a drilling fluid. This may be used, for instance, to identify DBM based on the correlated temperature measurements at 686. From the DBM identified at 686, an actionable insight or other mitigation action may be determined at 688. Identifying the mitigation action may also be performed to reduce (e.g., stop or slow) DBM.

While embodiments disclosed herein may be used in the oil, gas, hydrocarbon exploration or production environments, or in the production of other natural resources, such environments are merely illustrative. Systems, tools, assemblies, methods, devices, and other components of the present disclosure, or which would be appreciated in view of the disclosure herein, may be used in other applications and environments. In other embodiments, embodiments of the present disclosure may be used outside of a downhole environment, including in connection with the placement of utility lines, or in the automotive, aquatic, aerospace, hydroelectric, manufacturing, or telecommunications industries.

In the description herein, various relational terms may be used to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," and the like, may be used to describe various components, including their operational or illustrated position relative to one or more other components. Relational terms do not indicate a particular orientation for each embodiment within the scope of the description or claims, but are intended for convenience in facilitating reference to various components. Thus, such relational aspects may be reversed, flipped, rotated, moved in space, placed in a diagonal orientation or position, placed horizontally or vertically, or similarly modified.

Certain descriptions or designations of components as "first," "second," "third," and the like are also used to differentiate between identical components or between components which are similar in use, structure, or operation. Such language is not intended to limit a component to a singular designation or require multiple components. As such, a component referenced in the specification as the "first" component may be the same or different than a component that is referenced in the claims as a "first" component, and a claim may include a "first" component without requiring the existence of a "second" component.

Furthermore, while the description or claims may refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in certain embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral"

or "integrally" formed include components made from the same piece of material, or sets of materials, such as by being commonly molded or cast from the same material, in the same molding or casting process, or commonly machined from the same piece of material stock. Components that are "integral" should also be understood to be "coupled" together.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The abstract at the end of this disclosure is provided to allow the reader to quickly ascertain the general nature of some embodiments of the present disclosure. It is submitted with the understanding that it will not be used to interpret or limit the scope or meaning of the claims.

What is claimed is:

1. A drill bit for at-bit detection of drill bit metamorphism, comprising:

a bit head;

at least one cutting element connected to the bit head;

a temperature sensor coupled to the at least one cutting element;

an electronics module in communication with the temperature sensor, the electronics module configured to use temperature data from the temperature sensor and detect drill bit metamorphism; and a wiring conduit from the temperature sensor or the at least one cutting element and through at least a portion of the bit head to the electronics module.

2. The drill bit of claim 1, further comprising a bit pin or a bit box coupled to the bit head.

3. The drill bit of claim 2, further comprising one or more seals between the bit head and the bit pin or bit box.

4. The drill bit of claim 3, the one or more seals including a seal around the wiring conduit at an interface between the bit head and the bit pin or bit box.

5. The drill bit of claim 1, the wiring conduit extending through an integrally formed portion of the bit head and to the electronics module.

6. The drill bit of claim 1, the electronics module including at least one of a microcontroller, memory, accelerometer, an angular rate sensor, a thermocouple amplifier, a battery, or a power generator.

7. A method for performing at-bit detection of drill bit metamorphism, comprising:

detecting temperature data at a cutting element of a drill bit using a temperature sensor in or on the cutting element;

recovering the temperature data from the drill bit;

producing synchronized data by synchronizing the temperature data with at least one of surface gas data or drilling data; and identifying drill bit metamorphism from the synchronized data.

8. The method of claim 7, wherein recovering the temperature data includes recovering the temperature data at a surface location after tripping the drill bit to the surface location.

9. The method of claim 7, further comprising:

using a downhole communication tool, sending the temperature data to surface; and combining the temperature data with surface gas data.

10. The method of claim 9, further comprising processing the temperature data downhole, and wherein the temperature data sent to the surface is processed temperature data.

11. The method of claim 10, further comprising generating one or more of a flag, a risk rating, or actionable insight from the processed temperature data.

12. The method of claim 7, wherein synchronizing the temperature data includes synchronizing based on one or both of time or depth.

13. The method of claim 7, further comprising constructing one or more models of bit measurements relative to surface gas measurements.

14. A method for detecting drill bit metamorphism, comprising:

measuring temperature measurements at one or more points of contact between a downhole tool and a rock;

correlating the temperature measurements with a production of gas in drilling fluid; and identifying drill bit metamorphism based on the correlated temperature measurements.

15. The method of claim 14, wherein the drilling fluid includes an oil-based mud.

16. The method of claim 14, wherein the gas includes hydrogen gas.

17. The method of claim 14, wherein the one or more points of contact include a cutting element on the downhole tool.

18. The method of claim 14, further comprising identifying a mitigation action to reduce or slow the drill bit metamorphism.

19. The method of claim 14, wherein correlating the temperature measurements occurs at the downhole tool.

* * * * *